US007525059B2

(12) United States Patent
Masuda et al.

(10) Patent No.: US 7,525,059 B2
(45) Date of Patent: Apr. 28, 2009

(54) PUSH SWITCH

(75) Inventors: Masahiro Masuda, Okayama (JP); Yasunori Yanai, Okayama (JP); Yoshikazu Yagi, Okayama (JP)

(73) Assignee: Panasonic Corporation, Osaka (JP)

( * ) Notice: Subject to any disclaimer, the term of this patent is extended or adjusted under 35 U.S.C. 154(b) by 149 days.

(21) Appl. No.: 11/747,534

(22) Filed: May 11, 2007

(65) Prior Publication Data

US 2007/0284236 A1 Dec. 13, 2007

(30) Foreign Application Priority Data

Jun. 8, 2006 (JP) ..... 2006-159436

(51) Int. Cl.
*H01H 5/30* (2006.01)

(52) U.S. Cl. ..... 200/406

(58) Field of Classification Search ..... 200/406, 200/516, 533, 284, 292, 275, 294, 307
See application file for complete search history.

(56) References Cited

U.S. PATENT DOCUMENTS 4,359,614 A * 11/1982 Green et al. ..... 200/5 R
4,778,965 A * 10/1988 Valenzona ..... 200/296
6,489,580 B2 * 12/2002 Yanai et al. ..... 200/406
6,809,272 B2 * 10/2004 Yamada ..... 200/1 B
6,815,628 B2 * 11/2004 Okita et al. ..... 200/406
6,894,240 B2 * 5/2005 Komoto et al. ..... 200/512
6,967,295 B2 * 11/2005 Ting ..... 200/51 R
7,022,928 B2 * 4/2006 Watanabe et al. ..... 200/406
7,157,650 B2 * 1/2007 Rochon ..... 200/1 B

FOREIGN PATENT DOCUMENTS

JP 2005-122989 5/2005

* cited by examiner

*Primary Examiner*—Michael A Friedhofer
(74) *Attorney, Agent, or Firm*—RatnerPrestia

(57) ABSTRACT

A push switch is arranged to be mounted on a board. The push switch includes a case, a plurality of contacts provided in the case, an operation body for activating the plurality of contacts upon being pushed in an operation direction parallel to the surface of the board, first and second terminals protruding from the case. The case has first and second side surfaces opposite to each other. The first terminal includes a first base portion protruding from the first side surface of the case, and a first end portion extending from the first base portion in a direction non-parallel to perpendicular to the operation direction. The second terminal includes a second base portion protruding from the second side surface of the case and a second end portion extending from the second base portion in a direction non-parallel to perpendicular to the operation direction. The push switch has a small size and is mounted securely onto a board.

11 Claims, 16 Drawing Sheets

PUSH SWITCH

FIELD OF THE INVENTION

The present invention relates to a push switch including an operation body to be pushed along a direction parallel to a surface of a circuit board the push switch is mounted onto.

BACKGROUND OF THE INVENTION

Various types of push switches are used for input sections of electronic devices. A push switch which is activated by pushing an operation body of the switch in parallel to a surface of a board the push switch is mounted onto is often used.

FIG. 9 is a plan view of a conventional push switch 501 disclosed in Japanese Patent Laid-Open Publication No. 2005-122989. FIG. 10 is a cross sectional view of push switch 501 at line 10-10 shown in FIG. 9.

Case 1 made of resin material has a recess opening upward. Inner fixed contact 2A and an outer fixed contact are located in the recess and are fixed unitarily within case 1. Terminals 5 connected with inner fixed contact 2A and the outer fixed contact protrude from side surfaces of case 1 opposite to each other, respectively. Terminals 5 have ends which are bent up, and have shapes suitable for being mounted onto the surface of a board.

Movable contact 7 is made of a thin metal plate. Movable contact 7 is accommodated in the recess of case 1, and has its outer circumference placed on the outer fixed contact. The recess of case 1 is covered with protection film 8 adhered onto on an upper surface of case 1. Movable contact 7 has a square shape, or circular shape.

Operation body 10 made of resin material includes operation portion 10A protruding to the front and driving portion 10B located behind operation portion 10A. Operation body 10 is placed on protection film 8 such that the operation body is movable in front and back directions on the upper surface of case 1.

Metal cover 15 covers case 1 with operation body 10 between the cover and the case. Slope portion 15A is formed at the central part of metal cover 15 and inclines towards case 1. Slope portion 15A is positioned behind driving portion 10B. An end of driving portion 10B contacts a front surface of slope portion 15A which inclines. Metal cover 15 has leg 15B which can be soldered and which protrudes downward at the side surface of case 1.

FIG. 11 is a side view of push switch 501 mounted on surface 501C of board 501A. Operation portion 10A protrudes to the front from end 501B of board 501A. Terminals 5 are connected with surfaces of corresponding lands by soldering, thereby mounting push switch 501 on surface 501C of board 501A. Leg 15B of metal cover 15 is also soldered to a land corresponding to the leg. Terminals 5 are drawn from both side surfaces of case 1 such that terminals 5 protrude perpendicularly to front and back directions, i.e., a moving direction of operation portion 10A. Terminals 5 are fixed to the board with solder such that respective ends of terminals 5 which are bent up are in parallel with the moving direction of operation portion 10A.

If an operating force is applied to operation portion 10A for pushing operation portion 10A in a direction parallel to surface 501C, operation body 10 moves along the parallel direction by sliding on protection film 8 covering the upper surface of case 1. Then, the end of driving portion 10B is guided downward along slope portion 15A to apply a downward force to movable contact 7 located beneath slope portion 15A.

When the downward force exceeds a predetermined level, movable contact 7 is inverted at the central part and has its central bottom contact inner fixed contact 2A. Thereby, terminals 5 are connected via movable contact 7, thus turning on push switch 501.

Upon the force applied to operation portion 10A being released, movable contact 7 returns to have its original shape by its restoring force and pushes driving portion 10B upward. Driving portion 10B which is pushed up is guided along slope portion 15A and causes operation body 10 to be pushed back to the front, thereby turning off push switch 501, as shown in FIG. 10.

In the conventional push switch 501, soldered portions of terminals 5 and leg 15B of metal cover 15 receive the operating force applied to operation portion 10A. Even if push switch 501 is small in size, a certain clearance between leg 15B and terminals 5 are necessary to avoid possible mutual contact of solder applied to terminals 5 and leg 15B. This structure accordingly prevents push switch 501 from having a small size.

If the number of constituent members, such as terminal 5 and leg 15B, which are connected with board 501A, is decreased in order to reduce the size of push switch 501 and to allow the push switch to be suitable for a portable device, board 501A may be removed when the portable device is dropped.

SUMMARY OF THE INVENTION

A push switch is arranged to be mounted on a board. The push switch includes a case, a plurality of contacts provided in the case, an operation body for activating the plurality of contacts upon being pushed in an operation direction parallel to the surface of the board, first and second terminals protruding from the case. The case has first and second side surfaces opposite to each other. The first terminal includes a first base portion protruding from the first side surface of the case, and a first end portion extending from the first base portion in a direction non-parallel to perpendicular to the operation direction. The second terminal includes a second base portion protruding from the second side surface of the case and a second end portion extending from the second base portion in a direction non-parallel to perpendicular to the operation direction.

The push switch has a small size and is mounted securely onto a board.

DETAILED DESCRIPTION OF THE PREFERRED EMBODIMENT

Figure 1:
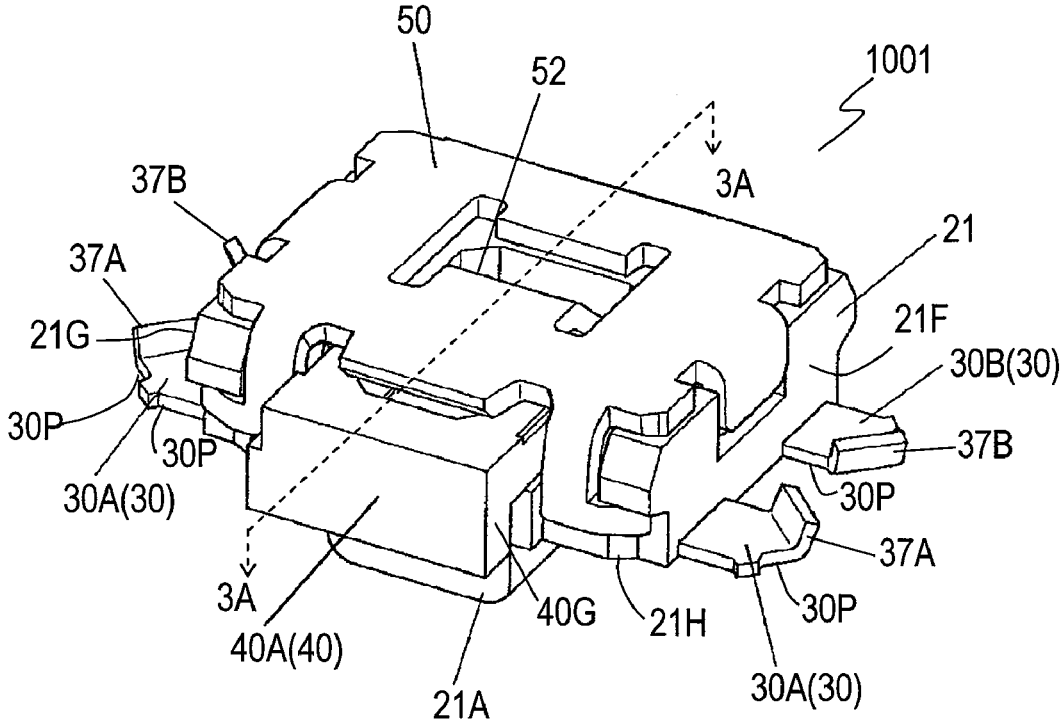
FIG. 1 is a perspective view of a push switch in accordance with an exemplary embodiment of the present invention.
Figure 2:
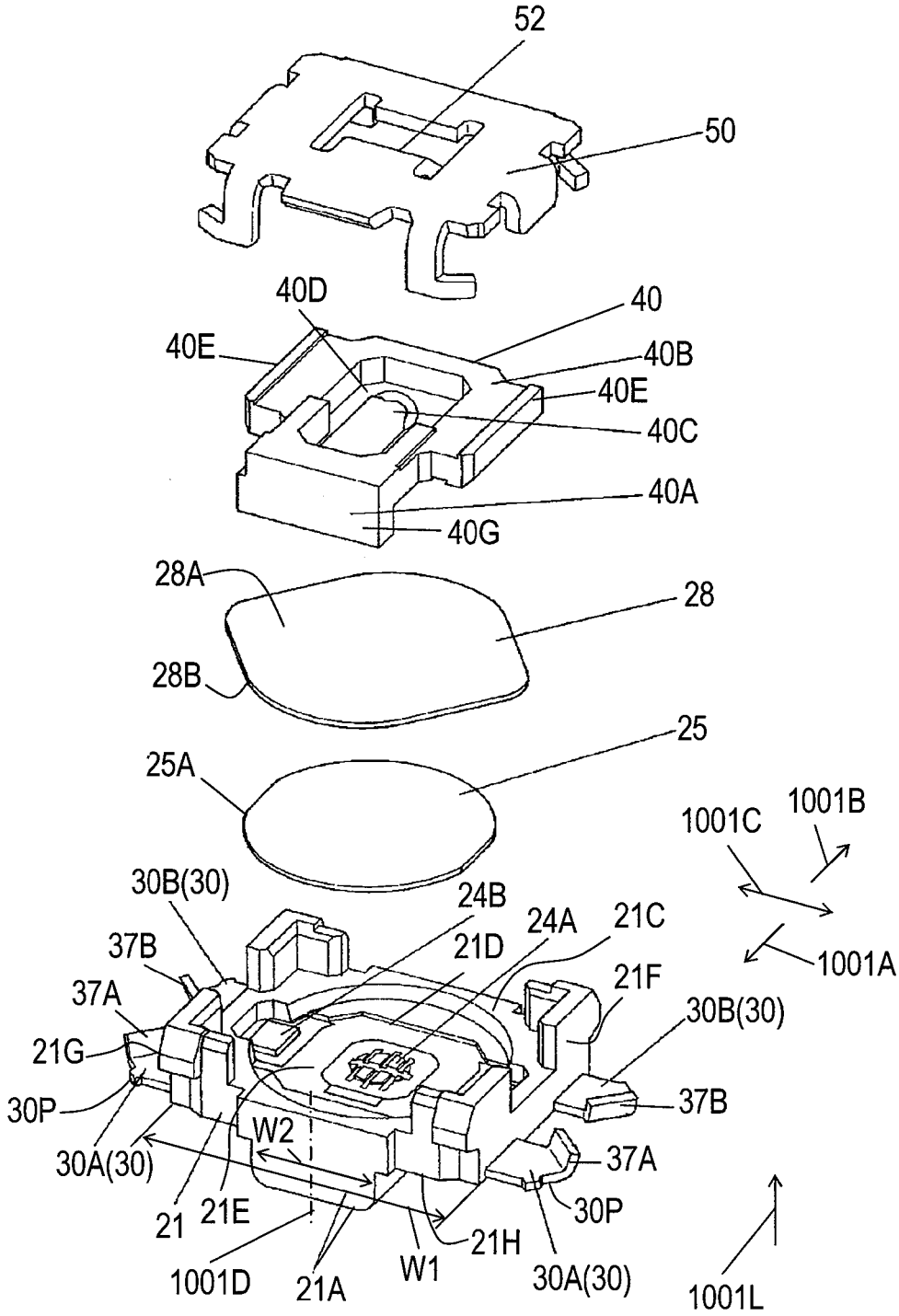
FIG. 2 is an exploded perspective view of the push switch in accordance with the embodiment.
Figure 3A:
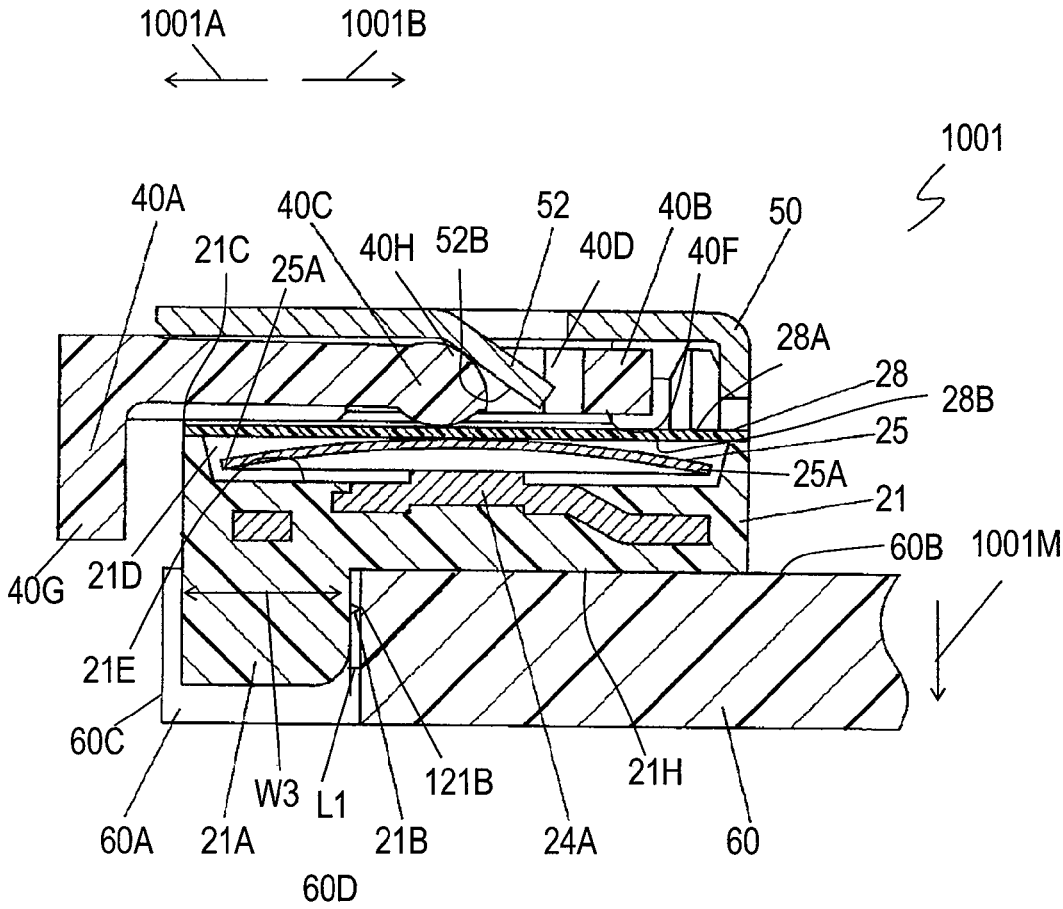
FIG. 3A is a cross sectional view of the push switch at line 3A-3A shown in FIG. 1.

FIGS. 1 and 2 are a perspective view and an exploded perspective view of push switch 1001 in accordance with an exemplary embodiment of the present invention, respectively. FIG. 3A is a cross sectional view of push switch 1001 at line 3A-3A shown in FIG. 1. Push switch 1001 is arranged to be mounted on surface 60B of board 60.

Case 21 made of insulating resin has an upper surface having recess 21D provided therein, and has a substantially rectangular shape viewed from upper surface 21C. Inner fixed contact 24A and outer fixed contact 24B are exposed from bottom 21E of recess 21D, and are fixed by insert-molding. Terminals 30 connected to inner fixed contact 24A and outer fixed contact 24B protrude from side surfaces 21F and 21G of case 21 opposite to each other, respectively. Bottom surface 30P of terminal 30 is on the same plane as bottom surface 21H of case 21. Bottom surface 21H is arranged to be parallel with surface 60B when the switch is mounted on board 60.

Recess 21D of case 21 accommodates movable contact 25 made of a thin metal plate. Outer circumferential edge 25A of movable contact 25 is placed on outer fixed contact 24B. Recess 21D of case 21 is covered with protection film 28 adhered onto upper surface 21C of case 21.

Operation body 40 is placed on upper surface 28A of protection film 28, and is covered with metal cover 50 assembled to case 21. Operation body 40 has operation portion 40A protruding from cover 50 in direction 1001A. When operation portion 40A is pushed in direction 1001B opposite to direction 1001A, operation body 40 moves in direction 1001A. Operation body 40 includes operation portion 40A, frame portion 40B, and driving portion 40C which are molded unitarily with resin. Frame portion 40B is located from operation portion 40A in direction 1001B, and has a flat plate shape having through-hole 40D provided therein. Driving portion 40C has substantially a rod shape extending from operation portion 40A in direction 1001B to through-hole 40D of frame portion 40B. Frame portion 40B is placed on upper surface 28A of protection film 28 and has both side portions 40E guided by inner surfaces of case 21, thus allowing operation body 40 to move in directions 1001A and 1001B. Operation portion 40A has operation end 40G protruding downward to be lower than lower surface 40F of frame portion 40B, thus having substantially an L-shape. The operation end 40G is arranged to be pushed by a user.

Cover 50 includes slope portion 52 protruding downward into through-hole 40D of frame portion 40B of operation body 40. Slope portion 52 extends and inclines towards recess 21D and in direction 1001B. When operation portion 40A is not pushed or is not activated, end 40H of driving portion 40C of operation body 40 contacts lower surface 52B of slope portion 52 of cover 50.

Case 21 includes lower protrusion 21A protruding downward from bottom surface 21H, and two bumps 21B protruding from lower protrusion in direction 1001B. Width W1 of lower protrusion 21A in direction 1001C perpendicular to direction 1001B in which lower protrusion protrudes is about ⅓ to ¾ of width W2 of case 21 in direction 1001C. Width W3 of lower protrusion 21A in direction 1001B is large.

The center of case 21 in direction 1001C and the center of lower protrusion 21A in direction 1001C coincide on center line 1001D. Two bumps 21B are arranged symmetrically about center line 1001D and located away from center line 1001D by the same distances.

Terminals 30 connected with inner fixed contact 24A and outer fixed contact 24B protrude from side surfaces 21F and 21G of case 21, respectively. Terminals 30 include front terminals 30A and back terminals 30B located away from front terminal 30A in direction 1001B. A pair of front terminal 30A and back terminal 30B protrudes from side surface 21F of case 21, while another pair of front terminal 30A and back terminal 30B protrude from side surface 21G.

Terminals 30A and 30B are made of plate, such as brass plate having a thickness of 0.15 mm or phosphor bronze plate having a thickness ranging from 0.10 mm to 0.12 mm. Although the thickness is different depending on the materials, their soldering strength is the same. Namely, a phosphor bronze plate contains tin, and accordingly, has a soldering strength approximately 10% greater than that of a brass plate. Terminals 30 made of phosphor bronze allow switch 1001 to be thinner than terminals 30 made of brass. Terminals 30 (30A, 30B) have shapes suitable for being mounted on the surface. Namely, terminal 30 has bottom surface 30P flush with bottom surface 21H of case 21.

Figure 3B:
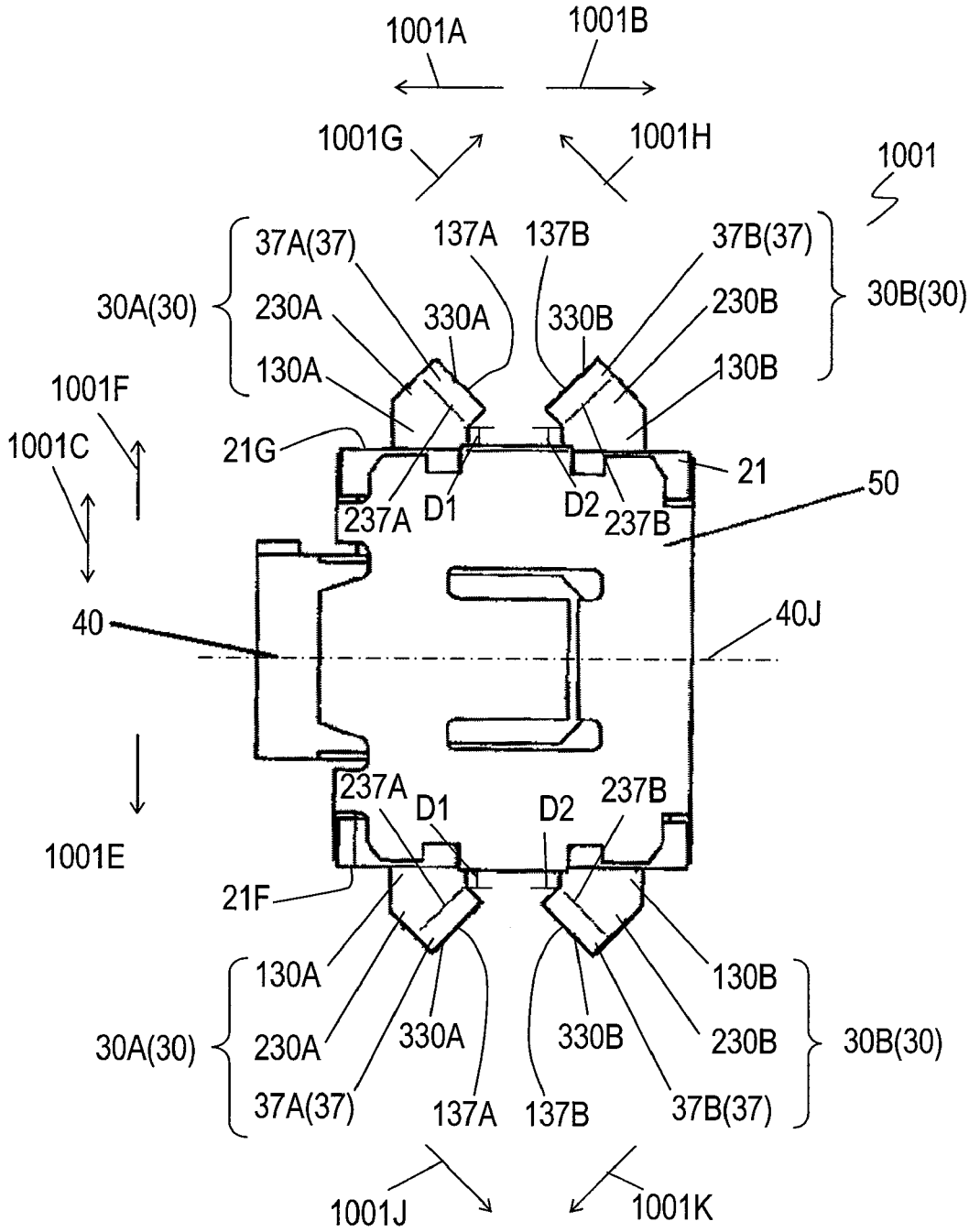
FIG. 3B is a plan view of the push switch in accordance with the embodiment.
Figure 3C:
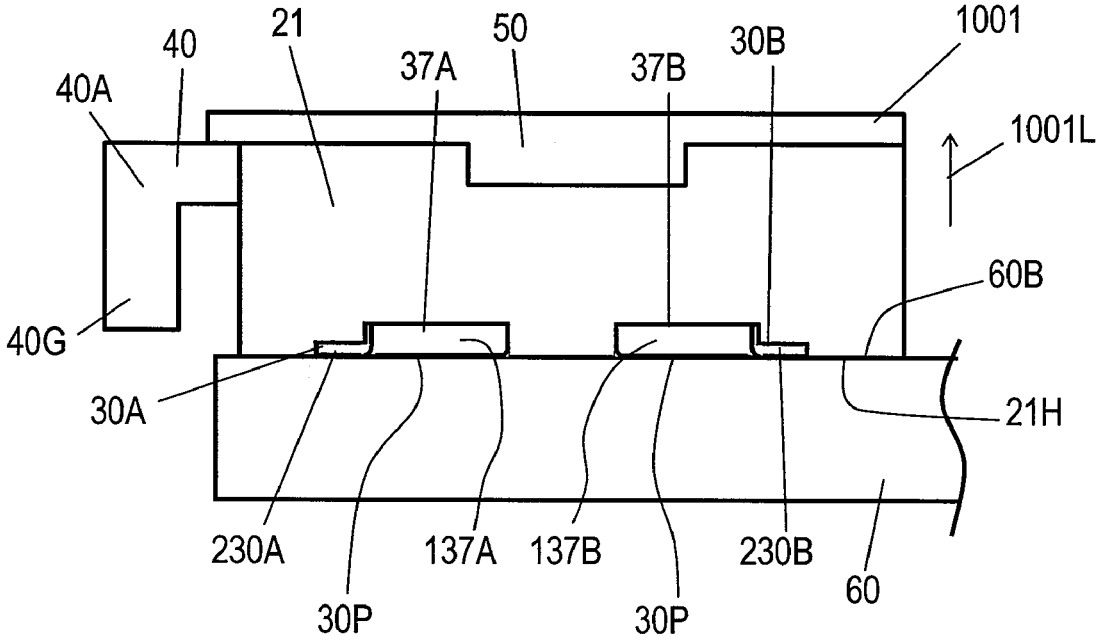
FIG. 3C is a side view of the push switch in accordance with the embodiment.

FIGS. 3B and 3C are a plan view and a side view of push switch 1001.

Front terminal 30A protruding from side surface 21G of case 21 includes base portion 130A and end portion 230A. Base portion 130A extends from side surface 21G by predetermined distance D1 in direction 1001F perpendicular to operation direction 1001B. End portion 230A extends from base portion 130A in direction 1001G approaching operation direction 1001B by an angle of 45°, and has a width identical to that of base portion 130A. Ascent portion 37A is provided at end 330A of front terminal 30A, i.e., at end 330A of end portion 230A. Ascent portion 37A protrudes in direction 1001L perpendicular to and away from bottom surface 30P, and is formed by bending the end portion. Ascent portion 37A has surface 137A perpendicular to bottom surface 30P. Surface 137A faces towards direction 1001G and is perpendicular to direction 1001G. Surface 137A is connected with end portion 230A at straight line 237A.

Back terminal 30B protruding from side surface 21G of case 21 includes base portion 130B and end portion 230B. Base portion 130B extends from side surface 21G by predetermined distance D2 in direction 1001F perpendicular to operation direction 1001B. End portion 230B extends from base portion 130B in direction 1001H approaching operation direction 1001A by an angle of 45°, and has a width identical to that of base portion 130B. Ascent portion 37B is provided at end 330B of back terminal 30B, i.e., at end 330B of end portion 230B. Ascent portion 37B protrudes in direction 1001L perpendicular to and away from bottom surface 30P, and is formed by bending the end portion. Ascent portion 37B has surface 137B perpendicular to bottom surface 30P. Surface 137B faces towards direction 1001H and is perpendicular to direction 1001H. Surface 137B is connected with end portion 230B at straight line 237B.

Front terminal 30A protruding from side surface 21F of case 21 includes base portion 130A and end portion 230A. Base portion 130A extends from side surface 21F by predetermined distance D1 in direction 1001E perpendicular to operation direction 1001B. End portion 230A extends from base portion 130A in direction 1001J approaching operation direction 1001B by an angle of 45°, and has a width identical to that of base portion 130A. Ascent portion 37A is provided at end 330A of front terminal 30A, i.e., at end 330A of end portion 230A. Ascent portion 37A protrudes in direction 1001L perpendicular to and away from bottom surface 30P, and is formed by bending the end portion. Ascent portion 37A has surface 137A perpendicular to bottom surface 30P. Surface 137A faces towards direction 1001J and is perpendicular to direction 1001J. Surface 137A is connected with end portion 230A at straight line 237A.

Back terminal 30B protruding from side surface 21F of case 21 includes base portion 130B and end portion 230B. Base portion 130B extends from side surface 21F by predetermined distance D2 in direction 1001E perpendicular to operation direction 1001B. End portion 230B extends from base portion 130B in direction 1001K approaching operation direction 1001A by an angle of 45°, and has a width identical to that of base portion 130B. Ascent portion 37B is provided at end 330B of back terminal 30B, i.e., at end 330B of end portion 230B. Ascent portion 37B protrudes in direction 1001L perpendicular to and away from bottom surface 30P, and is formed by bending the end portion. Ascent portion 37B has surface 137B perpendicular to bottom surface 30P. Surface 137B faces towards direction 1001K and is perpendicular to direction 1001K. Surface 137B is connected with end portion 230B at straight line 237B.

The angle between the directions in which the end portion and the base portion extend may be an angle other than 45°.

Figure 3D:
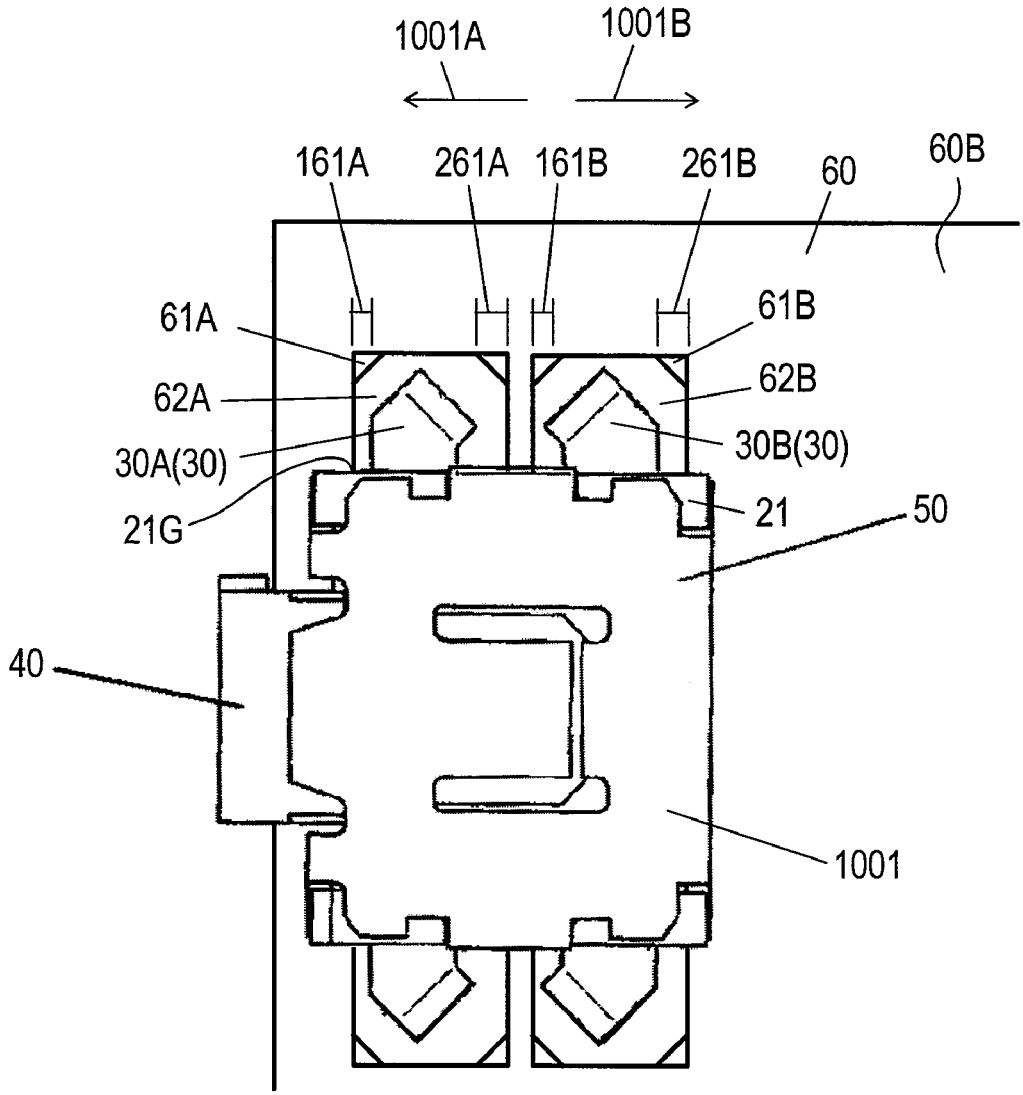
FIG. 3D is a plan view of the push switch mounted on a board in accordance with the embodiment.

FIG. 3D is a plan view of push switch 1001 mounted onto circuit board 60. As shown in FIGS. 3A and 3D, push switch 1001 is arranged to be placed on surface 60B of circuit board 60. Terminals 30A and 30B (30) are connected with solder fillets 62A and 62B to lands 61A and 61B made of conductive material provided on surface 60B, respectively, thus mounting push switch 1001 on board 60.

Circuit board 60 has cutout 60A having a rectangular shape provided in edge 60C. Edge surface 60D is located on cutout 60A of circuit board 60. Lower protrusion 21A is placed in cutout 60A. Tip 121B of bump 21B contacts edge surface 60D of cutout 60A. When circuit board 60 is manufactured, cutout 60A may be formed, thereby not increasing its manufacturing time or cost. While terminals 30A and 30B are placed on lands 61A and 61B to be connected with terminals 30A and 30B, respectively, lands 61A and 61B have portions 261A and 261B located in direction 1001B from terminals 30A and 30B, respectively, and has portions 161A and 161B located in direction 1001A from terminals 30A and 30B, respectively. The areas of portions 261A and 261B of land 61A and 61B are determined to be larger than those of portions 161A and 161B, respectively. This arrangement causes solder fillet 62A and 62B to pull switch 1001 in operation direction 1001B when terminals 30A and 30B are soldered on land 61A and 61B, respectively. Thus, push switch 1001 is mounted easily, as shown in FIGS. 3A and 3D.

As shown in FIG. 3B, terminals 30A and 30B include base portions 130A and 130B extending from side surface 21G in direction 1001F and end portions 230A and 230B extending from portions 130A and 130B in directions 1001G and 1001H deviating from direction 1001F, respectively. Terminals 30A and 30B include base portions 130A and 130B extending from side surface 21F in direction 1001E and end portions 230A and 230B extending from base portions 130A and 130B in directions 1001J and 1001K deviating from direction 1001E, respectively. Thus, each of terminals 30A and 30B extends in a direction which changes, hence having an area and an outer side distance larger than terminal 5 of conventional push switch 501 shown in FIG. 9. Terminal 30A and 30B of push switch 1001 have large contact areas which contact lands 61A and 61B, respectively, and which are larger than those of conventional push switch 501, accordingly being mounted on board 60 securely.

Ascent portions 37A and 37B provided at ends 330A and 330B of terminals 30A and 30B have surfaces 137A and 137B which are non-parallel with, i.e., deviate from operation direction 1001B, respectively. This arrangement allows surfaces 137A and 137B to have large areas projecting in direction 1001B on solder fillet 62A and 62B which connect terminals 30A and 30B with lands 61A and 61B, respectively. Terminals 30A and 30B have large resistance to forces in direction 1001B and direction 1001A opposite to direction 1001B, accordingly mounting push switch 1001 on board 60 securely against an operation force applied to operation body 40.

When solder fillets 62A and 62B are formed, excessive solder and flux appeared between each of bottom surfaces 30P of terminals 30A (30) and 30B (30) and each of lands 61A and 61B concentrate at ascent portions 37A and 37B extending perpendicularly to bottom surfaces 30P, and form solder fillets 62A and 62B. This operation prevents the excessive solder and flux from causing push switch 1001 to float from board 60. Edges of ascent portions 37A and 37B provided at ends 330A and 330B of terminals 30A and 30B are located close to side surfaces 21F and 21G of case 21. This structure causes excessive flux to be retained on side surface 21F and 21G, and accordingly allows recess 21D accommodating movable contact 25 and fixed contacts 24A and 24B therein to have a small wall thickness, accordingly allowing push switch 1001 to have a small size.

An operation of push switch 1001 will be described below.

An operating force in operation direction 1001B parallel to surface 60B of board 60 is applied to operation portion 40A of operation body 40 to push operation body 40, thereby causing operation body 40 to move along an axis 40J in direction 1001B while guided with case 21. Driving portion 40C contacting lower surface 52B of slope portion 52 moves accordingly downward while guided on lower surface 52B in direction 1001M towards movable contact 25. Upon moving, driving portion 40C applies a force pressing down the center of movable contact 25 via protection film 28. When the pressing force exceeds a predetermined level, movable contact 25 is elastically inverted at its center, and has its bottom surface contact inner fixed contact 24A. Thereby, inner fixed contact 24A and outer fixed contact 24B are connected electrically with each other via movable contact 25, thus turning on push switch 1001.

When the operating force applied to operation portion 40A is released, movable contact 25 returns to have its original shape by its restoring force and is removed from inner fixed contact 24A. Accordingly, inner fixed contact 24A is electrically disconnected from outer fixed contact 24B, thus turning off push switch 1001. Then, movable contact 25 pushes driving portion 40C upward via protection film 28. Driving portion 40C accordingly moves while being guided on lower surface 52B of slope portion 52 in direction 1001A opposite to operation direction 1001B, and operation body 40 is pushed back in direction 1001A, as shown in FIG. 3A.

As described below, push switch 1001 is mounted securely on circuit board 60 even being activated, thus being prevented from being removed.

Operation portion 40A includes operation end 40G protruding downward in direction 1001M towards a plane flush with surface 60B of board 60, i.e., with bottom surface 21H of case 21. Thus, operation portion 40A as a whole has an L-shape as viewed from its side. This shape allows the operating force to be applied to operation portion 40A at a height close to surface 60B of board 60. This structure prevents the operation force from producing a less moment than a push switch including an operation body to be pushed at a level higher than the surface of a board. Push switch 1001 reduces a force for removing terminal 30, especially front terminal 30A, perpendicular from board 60, accordingly being prevented from being peeled off from board 60 even being activated.

Operation end 40G of operation portion 40A may extend beyond lower surface 21H of case 21, i.e., beyond surface 60B of board 60. This structure allows the operating force to be applied to operation portion 40A at a level within the thickness of board 60. However, this structure causes the base portion of operation end 40G to receive a large stress when operation body 40 is activated. Therefore, if operation body 40 is made of only resin, the length of operation end 40G is determined according to durability of operation portion 40A. Operation end 40G of operation portion 40A preferably has a length substantially reaching the same level as surface 60B of board 60, or just above surface 60B.

Even in the case that operation end 40G of operation portion 40A extends in direction 1001M, push switch 1001 receives the moment causing the switch to float from the front according to the operating force. This moment influences the connection of terminals 30A and 30B. In order to reduce this influence, push switch 1001 is mounted on board 60 such that tips 121B of bump 21B protruding from lower protrusion 21A of case 21 contact edge surface 60D of cutout 60A of board 60.

The operating force applied to operation portion 40A during the activating of the push switch may cause case 21 to move in operation direction 1001B. In this case, bump 21B provided between edge surface 60D of cutout 60A of board 60 and lower protrusion 21A is compressed to alleviate the force pushing case 21 in direction 1001B. If the pushing force is excessively large, bump 21B may crush. Then, the pushing force is further alleviated. The crushing of bump 21B displaces case 21 in direction 1001B by distance L1, i.e., height L1 of bump 21B. Height L1 is determined so that the displacement of case 21 may not influence the connection between terminals 30A and 30B and lands 61A and 61B even if case 21 is displaced by distance L1 in direction 1001B.

If bump 21B crushes, lower protrusion 21A moves to contact edge surface 60D of cutout 60A, and stops. Since edge surface 60D which stops lower protrusion 21A is located at a height lower than the operating force, the moment produced by the operating force is small. Edge surface 60D at cutout 60A receives the pushing force in direction 1001B. Terminals 30A and 30B do not receive large load, accordingly providing push switch 1001 with a large resistance against the pushing force in direction 1001B. The diameter of bump 21B may be determined, such that bump 21B is compressed and does not crush when an ordinary operating force is applied to operating portion 40A, and bump 21B crushes when an excessive operating force larger than the ordinary force is applied.

Two front terminals 30A extending from side surfaces 21F and 21G, respectively, are arranged symmetrically to each other about moving axis 40J, and have shapes symmetrical to each other about moving axis 40J. Two back terminals 30B extending from side surfaces 21F and 21F, respectively, are arranged symmetrically to each other about moving axis 40J, and have shapes symmetrical to each other about moving axis 40J.

Figure 4A:
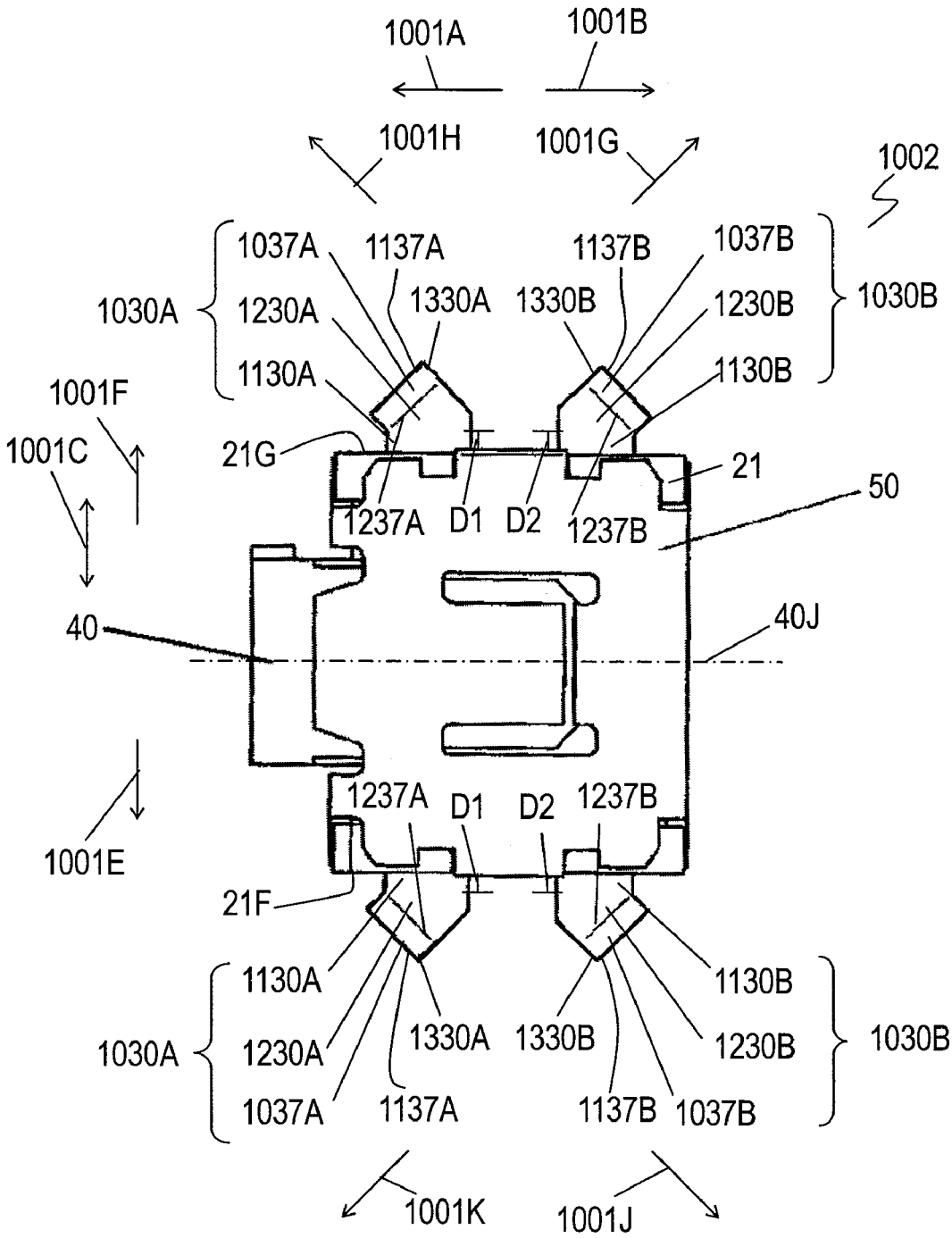
FIG. 4A is a plan view of another push switch in accordance with the embodiment.
Figure 4B:
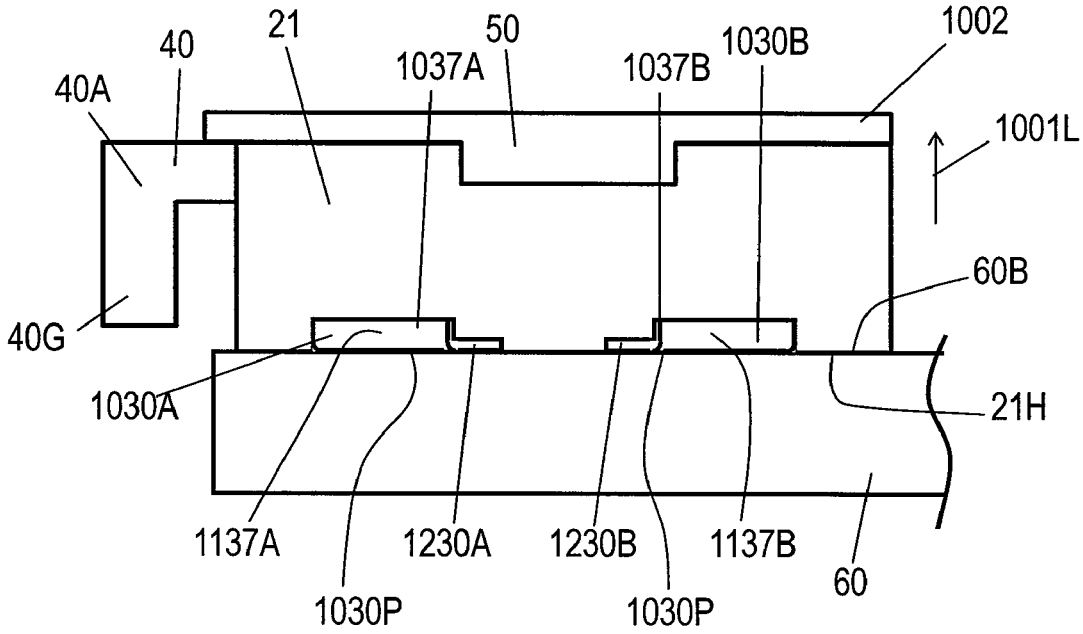
FIG. 4B is a side view of the push switch shown in FIG. 4A.

FIGS. 4A and 4B are a plan view and a side view of another push switch 1002 in accordance with the embodiment. In FIGS. 4A and 4B, the same components as those of push switch 1001 shown in FIGS. 3B and 3C are denoted by the same reference numerals, and their description will be omitted. Push switch 1002 includes front terminals 1030A and back terminals 1030B instead of front terminals 30A and back terminals 30B of push switch 1001 shown in FIG. 3B. Bottom surfaces 1030P of terminals 1030A and 1030B are flush with bottom surface 21H of case 21.

Front terminal 1030A protruding from side surface 21G of case 21 includes base portion 1130A and end portion 1230A. Base portion 1130A extends from side surface 21G by predetermined distance D1 in direction 1001F perpendicular to operation direction 1001B. End portion 1230A extends from base portion 1130A in direction 1001H approaching operation direction 1001A by an angle of 45°, and has a width identical to that of base portion 1130A. Ascent portion 1037A is provided at end 1330A of front terminal 1030A, i.e., at end 1330A of end portion 1230A. Ascent portion 1037A protrudes in direction 1001L perpendicular to and away from bottom surface 1030P, and is formed by bending the end portion. Ascent portion 1037A has surface 1137A perpendicular to bottom surface 1030P. Surface 1137A faces towards direction 1001H and is perpendicular to direction 1001H. Surface 1137A is connected with end portion 1230A at straight line 1237A.

Back terminal 1030B protruding from side surface 21G of case 21 includes base portion 1130B and end portion 1230B. Base portion 1130B extends from side surface 21G by predetermined distance D2 in direction 1001F perpendicular to operation direction 101B. End portion 1230B extends from base portion 1130B in direction 1001G approaching operation direction 1001B by an angle of 45°, and has a width identical to that of base portion 1130B. Ascent portion 1037B is provided at end 1330B of back terminal 1130B, i.e., at end 1330B of end portion 1230B. Ascent portion 1037B protrudes in direction 1001L perpendicular to and away from bottom surface 1030P, and is formed by bending the end portion. Ascent portion 1037B has surface 1137B perpendicular to bottom surface 1030P. Surface 1137B faces towards direction 1001G and is perpendicular to direction 1001G. Surface 1137B is connected with end portion 1230B at straight line 1237B.

Front terminal 1030A protruding from side surface 21F of case 21 includes base portion 1130A and end portion 1230A. Base portion 1130A extends from side surface 21F by predetermined distance D1 in direction 1001E perpendicular to operation direction 1001B. End portion 1230A extends from base portion 1130A in direction 1001K approaching operation direction 1001A by an angle of 45°, and has a width identical to that of base portion 1130A. Ascent portion 1037A is provided at end 1330A of front terminal 1030A, i.e., at end 1330A of end portion 1230A. Ascent portion 1037A protrudes in direction 1001L perpendicular to and away from bottom surface 1030P, and is formed by bending the end portion. Ascent portion 1037A has surface 1137A perpendicular to bottom surface 1030P. Surface 1137A faces towards direction 1001K and is perpendicular to direction 1001K. Surface 1137A is connected with end portion 1230A at straight line 1237A.

Back terminal 1030B protruding from side surface 21F of case 21 includes base portion 1130B and end portion 1230B. Base portion 1130B extends from side surface 21F by predetermined distance D2 in direction 1001E perpendicular to operation direction 1001B. End portion 1230B extends from base portion 1130B in direction 1001J approaching operation direction 1001B by an angle of 45°, and has a width identical to that of base portion 1130B. Ascent portion 1037B is provided at end 1330B of back terminal 1030B, i.e., at end 1330B of end portion 1230B. Ascent portion 1037B protrudes in direction 1001L perpendicular to and away from bottom surface 1030P, and is formed by bending the end portion. Ascent portion 1037B has surface 1137B perpendicular to bottom surface 1030P. Surface 1137B faces towards direction 1001J and is perpendicular to direction 1001J. Surface 1137B is connected with end portion 1230B at straight line 1237B.

Two front terminals 1030A extending from side surfaces 21F and 21G, respectively, are arranged symmetrically to each other about moving axis 40J, and have shapes symmetrical to each other about moving axis 40J. Two back terminals 1030B extending from side surfaces 21F and 21G, respectively, are arranged symmetrically to each other about moving axis 40J, and have shapes symmetrical to each other about moving axis 40J.

Push switch 1002 shown in FIGS. 4A and 4B can be mounted on board 60 as securely as push switch 1001 shown in FIG. 3B, thus providing the same effects. The angle between the directions in which the end portion and the base portion extend may be an angle other than 45°.

Figure 5A:
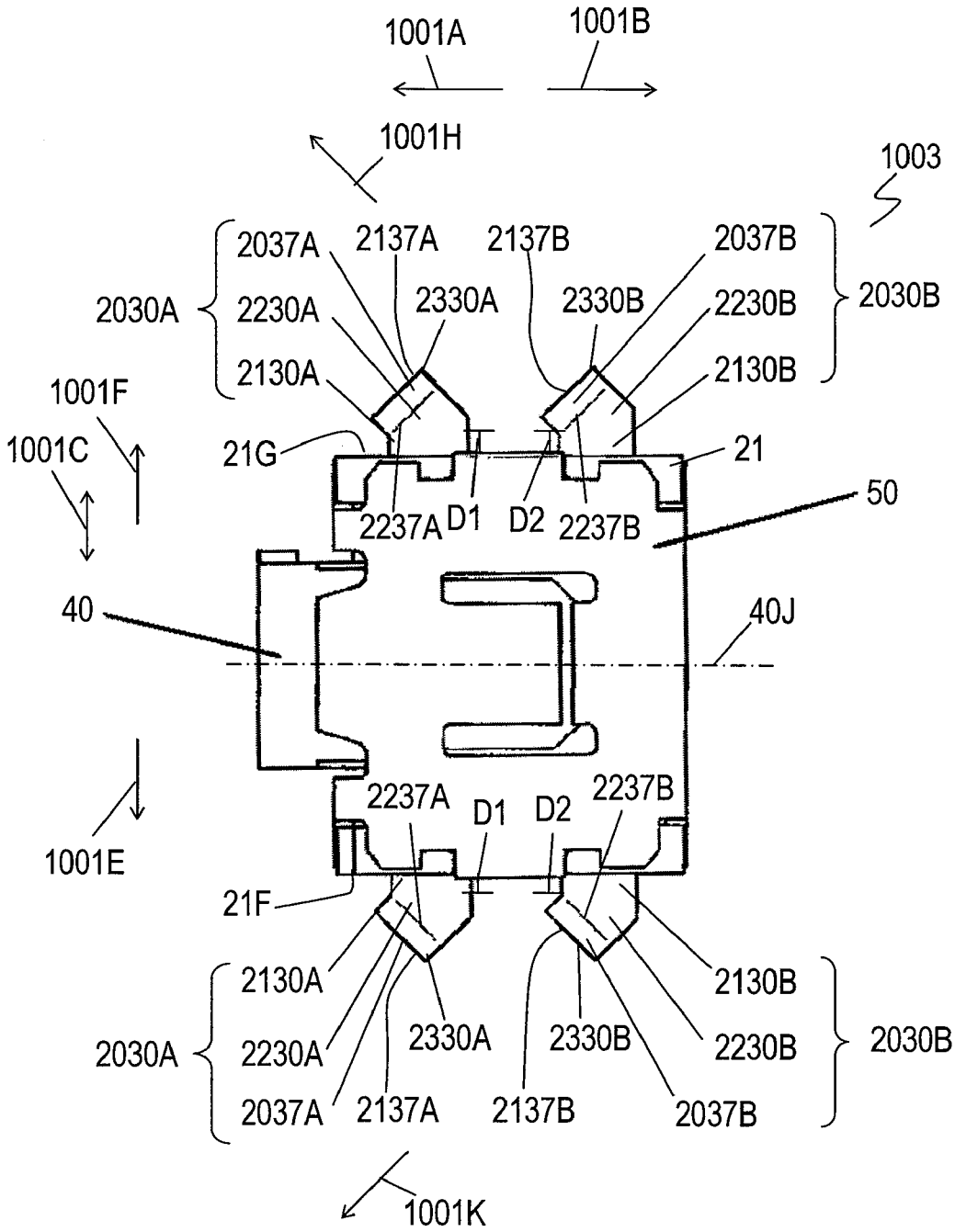
FIG. 5A is a plan view of a further push switch in accordance with the embodiment.
Figure 5B:
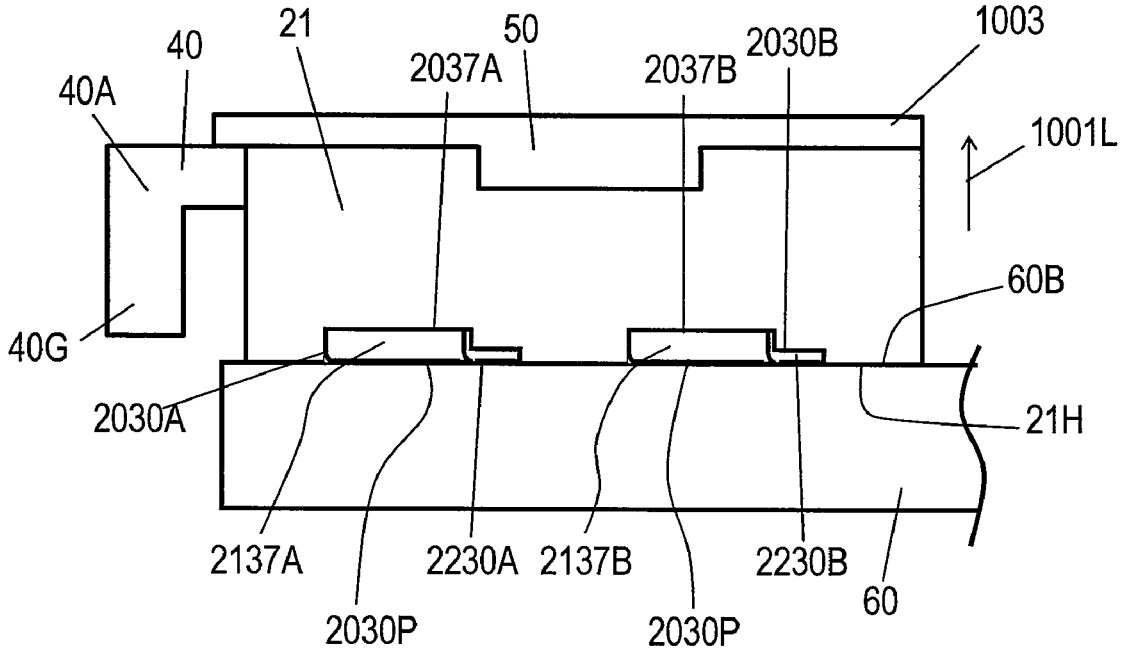
FIG. 5B is a side view of the push switch shown in FIG. 5A.

FIGS. 5A and 5B are a plan view and a side view of further push switch 1003 in accordance with the embodiment. In FIGS. 5A and 5B, the same components as those of push switch 1001 shown in FIGS. 3B and 3C are denoted by the same reference numerals, and their description will be omitted. Push switch 1003 includes front terminals 2030A and back terminals 2030B instead of front terminals 30A and back terminals 30B of push switch 1001 shown in FIG. 3B. Bottom surfaces 2030P of terminals 2030A and 2030B is flush with bottom surface 21H of case 21.

Front terminal 2030A protruding from side surface 21G of case 21 includes base portion 2130A and end portion 2230A. Base portion 2130A extends from side surface 21G by predetermined distance D1 in direction 1001F perpendicular to operation direction 1001B. End portion 2230A extends from base portion 2130A in direction 1001H approaching operation direction 1001A by an angle of 45°, and has a width identical to that of base portion 2130A. Ascent portion 2037A is provided at end 2330A of front terminal 2030A, i.e., at end 2330A of end portion 2230A. Ascent portion 2037A protrudes in direction 1001L perpendicular to and away from bottom surface 2030P, and is formed by bending the end portion. Ascent portion 2037A has surface 2137A perpendicular to bottom surface 2030P. Surface 2137A faces towards direction 1001H and is perpendicular to direction 1001H. Surface 2137A is connected with end portion 2230A at straight line 2237A.

Back terminal 2030B protruding from side surface 21G of case 21 includes base portion 2130B and end portion 2230B. Base portion 2130B extends from side surface 21G by predetermined distance D2 in direction 1001F perpendicular to operation direction 1001B. End portion 2230B extends from base portion 2130B in direction 1001H approaching operation direction 1001A by an angle of 45°, and has a width identical to that of base portion 2130B. Ascent portion 2037B is provided at end 2330B of back terminal 2130B, i.e., at end 2330B of end portion 2230B. Ascent portion 2037B protrudes in direction 1001L perpendicular to and away from bottom surface 2030P, and is formed by bending the end portion. Ascent portion 2037B has surface 2137B perpendicular to bottom surface 2030P. Surface 2137B faces towards direction 1001H and is perpendicular to direction 1001H. Surface 2137B is connected with end portion 2230B at straight line 2237B.

Front terminal 2030A protruding from side surface 21F of case 21 includes base portion 2130A and end portion 2230A. Base portion 2130A extends from side surface 21F by predetermined distance D1 in direction 1001E perpendicular to operation direction 1001B. End portion 2230A extends from base portion 2130A in direction 1001K approaching operation direction 1001A by an angle of 45°, and has a width identical to that of base portion 2130A. Ascent portion 2037A is provided at end 2330A of front terminal 2030A, i.e., at end 2330A of end portion 2230A. Ascent portion 2037A protrudes in direction 1001L perpendicular to and away from bottom surface 2030P, and is formed by bending the end portion. Ascent portion 2037A has surface 2137A perpendicular to bottom surface 2030P. Surface 2137A faces towards direction 1001K and is perpendicular to direction 1001K. Surface 2137A is connected with end portion 2230A at straight line 2237A.

Back terminal 2030B protruding from side surface 21F of case 21 includes base portion 2130B and end portion 2230B. Base portion 2130B extends from side surface 21F by predetermined distance D2 in direction 1001E perpendicular to operation direction 1001B. End portion 2230B extends from base portion 2130B in direction 1001K approaching operation direction 1001A by an angle of 45°, and has a width identical to that of base portion 2130B. Ascent portion 2037B is provided at end 2330B of back terminal 2030B, i.e., at end 2330B of end portion 2230B. Ascent portion 2037B protrudes in direction 1001L perpendicular to and away from bottom surface 2030P, and is formed by bending the end portion. Ascent portion 2037B has surface 2137B perpendicular to bottom surface 2030P. Surface 2137B faces towards direction 1001K and is perpendicular to direction 1001K. Surface 2137B is connected with end portion 2230B at straight line 2237B.

Two front terminals 2030A extending from side surfaces 21F and 21G, respectively, are arranged symmetrically to each other about moving axis 40J, and have shapes symmetrical to each other about moving axis 40J. Two back terminals 2030B extending from side surfaces 21F and 21G, respectively, are arranged symmetrically to each other about moving axis 40J, and have shapes symmetrical to each other about moving axis 40J.

Push switch 1003 shown in FIGS. 5A and 5B can be mounted on board 60 as securely as push switch 1001 shown in FIG. 3B, thus providing the same effects. The angle between the directions in which the end portion and the base portion extend may be an angle other than 45°.

Figure 6A:
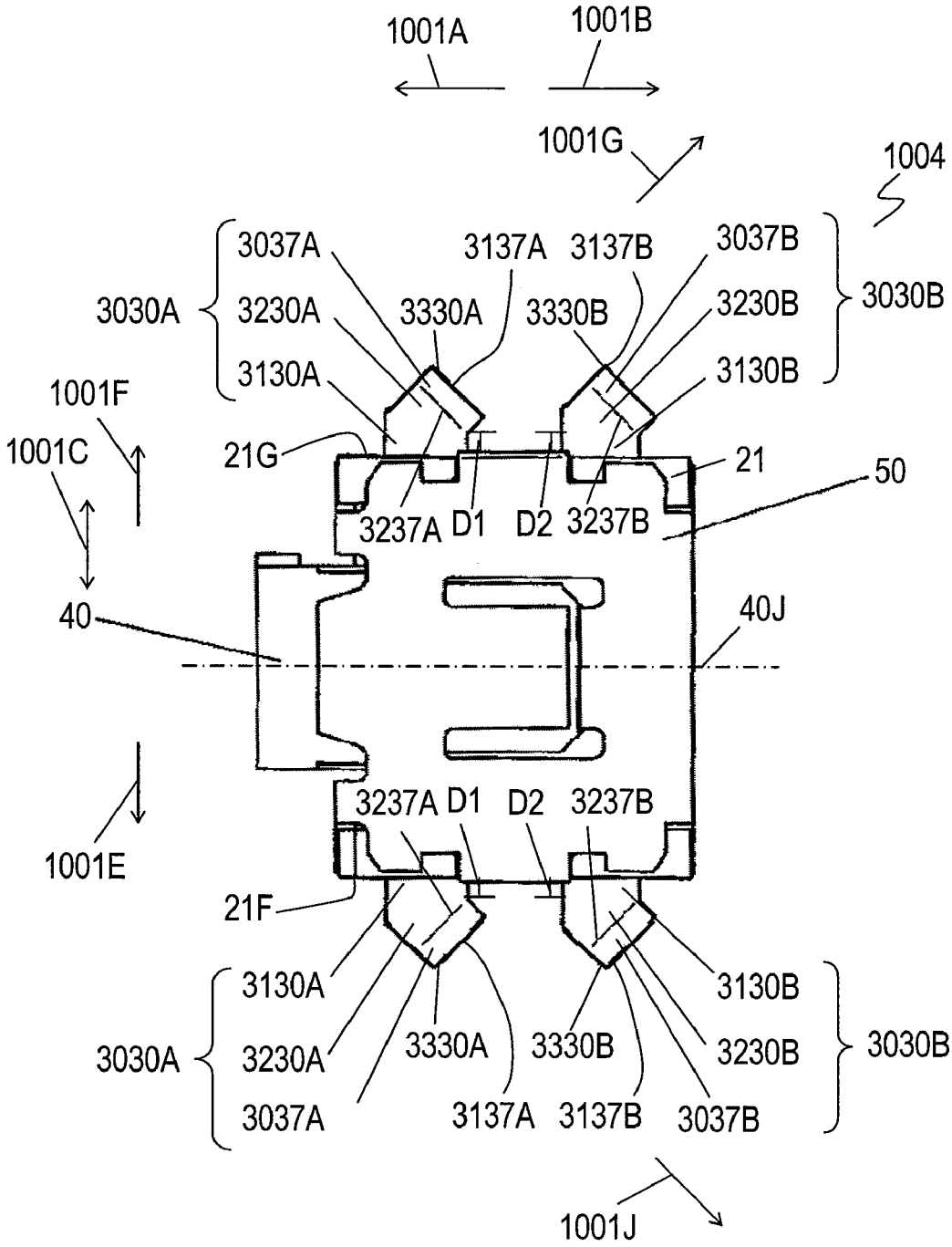
FIG. 6A is a plan view of a further push switch in accordance with the embodiment.
Figure 6B:
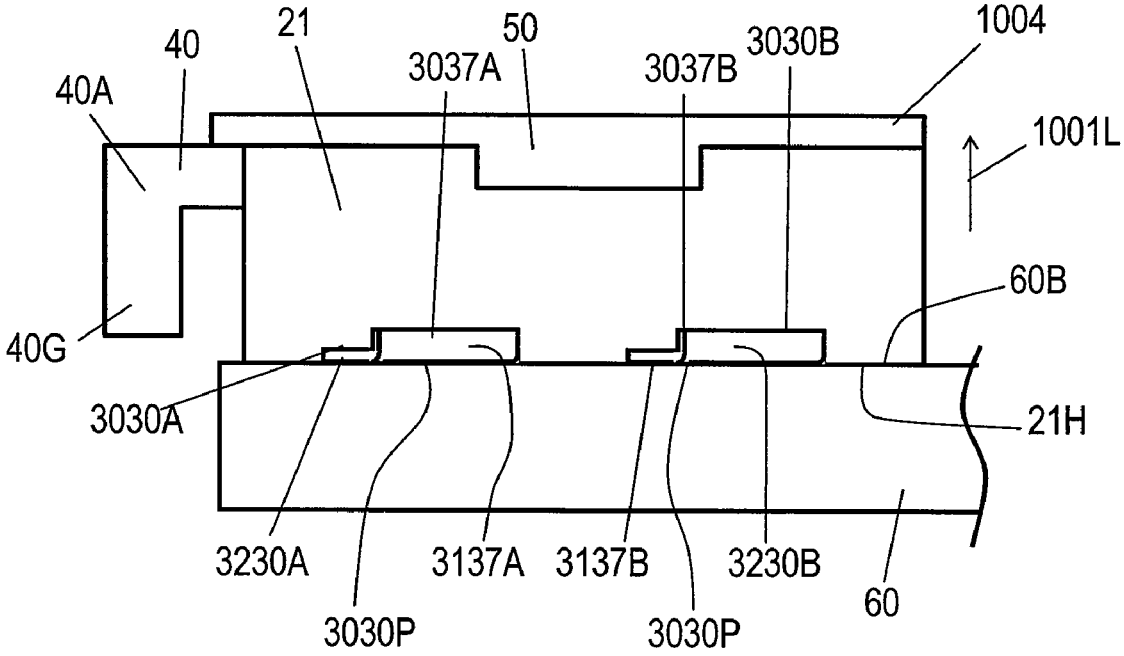
FIG. 6B is a side view of the push switch shown in FIG. 6A.

FIGS. 6A and 6B are a plan view and a side view of further push switch 1004 in accordance with the embodiment. In FIGS. 6A and 6B, the same components as those of push switch 1001 shown in FIGS. 3B and 3C are denoted by the same reference numerals, and their description will be omitted. Push switch 1004 includes front terminals 3030A and back terminals 3030B instead of front terminals 30A and back terminals 30B of push switch 1001 shown in FIG. 3B. Bottom surfaces 3030P of terminals 3030A and 3030B are flush with bottom surface 21H of case 21.

Front terminal 3030A protruding from side surface 21G of case 21 includes base portion 3130A and end portion 3230A. Base portion 3130A extends from side surface 21G by predetermined distance D1 in direction 1001F perpendicular to operation direction 1001B. End portion 3230A extends from base portion 3130A in direction 1001G approaching operation direction 1001B by an angle of 45°, and has a width identical to that of base portion 3130A. Ascent portion 3037A is provided at end 3330A of front terminal 3030A, i.e., at end 3330A of end portion 3230A. Ascent portion 3037A protrudes in direction 1001L perpendicular to and away from bottom surface 3030P, and is formed by bending the end portion. Ascent portion 3037A has surface 3137A perpendicular to bottom surface 3030P. Surface 3137A faces towards direction 1001G and is perpendicular to direction 1001G. Surface 3137A is connected with end portion 3230A at straight line 3237A.

Back terminal 3030B protruding from side surface 21G of case 21 includes base portion 3130B and end portion 3230B. Base portion 3130B extends from side surface 21G by predetermined distance D2 in direction 1001F perpendicular to operation direction 1001B. End portion 3230B extends from base portion 3130B in direction 1001G approaching operation direction 1001B by an angle of 45°, and has a width identical to that of base portion 3130B. Ascent portion 3037B is provided at end 3330B of back terminal 3130B, i.e., at end 3330B of end portion 3230B. Ascent portion 3037B protrudes in direction 1001L perpendicular to and away from bottom surface 3030P, and is formed by bending the end portion. Ascent portion 3037B has surface 3137B perpendicular to bottom surface 3030P. Surface 3137B faces towards direction 1001G and is perpendicular to direction 1001G. Surface 3137B is connected with end portion 3230B at straight line 3237B.

Front terminal 3030A protruding from side surface 21F of case 21 includes base portion 3130A and end portion 3230A. Base portion 3130A extends from side surface 21F by predetermined distance D1 in direction 1001E perpendicular to operation direction 1001B. End portion 3230A extends from base portion 3130A in direction 1001J approaching operation direction 1001B by an angle of 45°, and has a width identical to that of base portion 3130A. Ascent portion 3037A is provided at end 3330A of front terminal 3030A, i.e., at end 3330A of end portion 3230A. Ascent portion 3037A protrudes in direction 1001L perpendicular to and away from bottom surface 3030P, and is formed by bending the end portion. Ascent portion 3037A has surface 3137A perpendicular to bottom surface 3030P. Surface 3137A faces towards direction 1001J and is perpendicular to direction 1001J. Surface 3137A is connected with end portion 3230A at straight line 3237A.

Back terminal 3030B protruding from side surface 21F of case 21 includes base portion 3130B and end portion 3230B. Base portion 3130B extends from side surface 21F by predetermined distance D2 in direction 1001E perpendicular to operation direction 1001B. End portion 3230B extends from base portion 3130B in direction 1001J approaching operation direction 1001B by an angle of 45°, and has a width identical to that of base portion 3130B. Ascent portion 3037B is provided at end 3330B of back terminal 3030B, i.e., at end 3330B of end portion 3230B. Ascent portion 3037B protrudes in direction 1001L perpendicular to and away from bottom surface 3030P, and is formed by bending the end portion. Ascent portion 3037B has surface 3137B perpendicular to bottom surface 3030P. Surface 3137B faces towards direction 1001J and is perpendicular to direction 1001J. Surface 3137B is connected with end portion 3230B at straight line 3237B.

Two front terminals 3030A extending from side surfaces 21F and 21G, respectively, are arranged symmetrically to each other about moving axis 40J, and have shapes symmetrical to each other about moving axis 40J. Two back terminals 3030B extending from side surfaces 21F and 21G, respectively, are arranged symmetrically to each other about moving axis 40J, and have shapes symmetrical to each other about moving axis 40J.

Push switch 1004 shown in FIGS. 6A and 6B can be mounted on board 60 as securely as push switch 1001 shown in FIG. 3B, thus providing the same effects. The angle between the directions in which the end portion and the base portion extend may be an angle other than 45°.

Figure 7A:
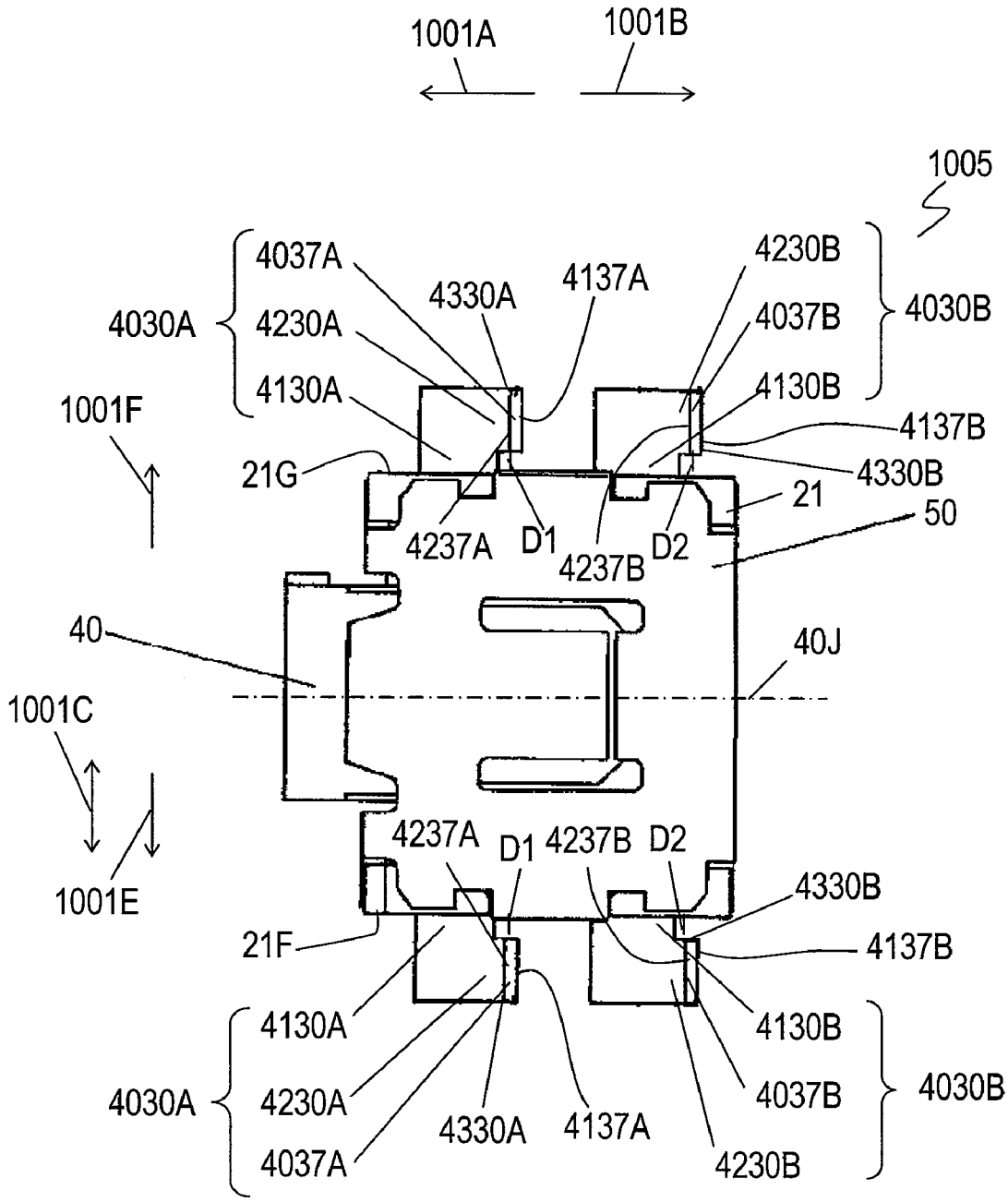
FIG. 7A is a plan view of a further push switch in accordance with the embodiment.
Figure 7B:
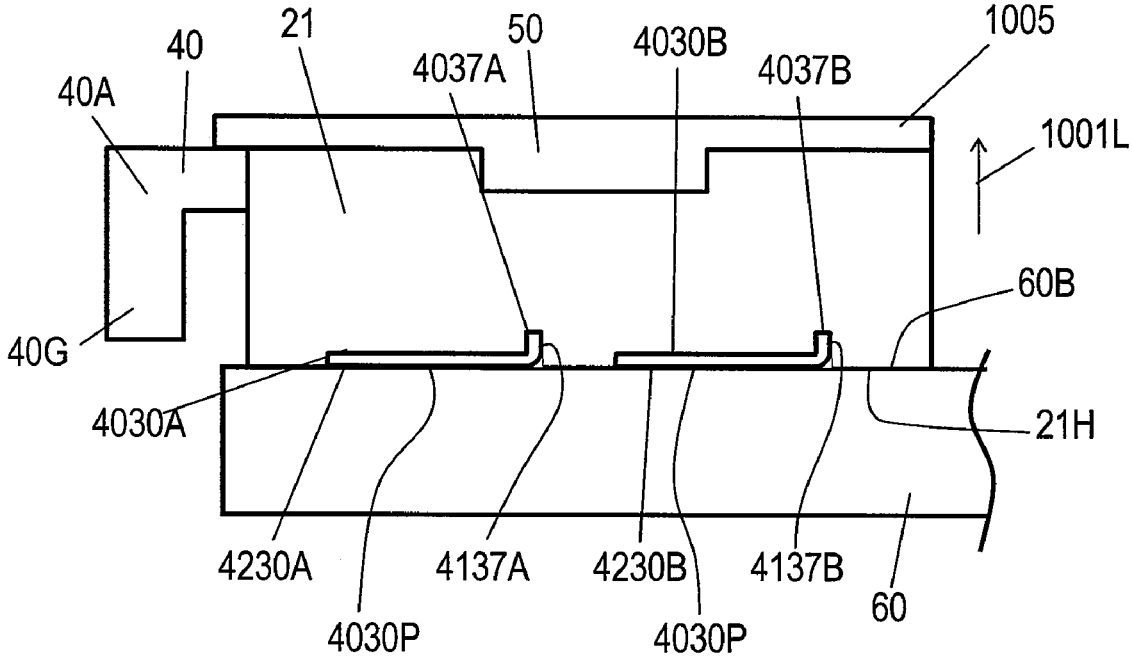
FIG. 7B is a side view of the push switch shown in FIG. 7A.

FIGS. 7A and 7B are a plan view and a side view of further push switch 1005 in accordance with the embodiment. In FIGS. 7A and 7B, the same components as those of push switch 1001 shown in FIGS. 3B and 3C are denoted by the same reference numerals, and their description will be omitted. Push switch 1005 includes front terminals 4030A and back terminals 4030B instead of front terminals 30A and back terminals 30B of push switch 1001 shown in FIG. 3B. Bottom surfaces 4030P of terminals 4030A and 4030B is flush with bottom surface 21H of case 21.

Front terminal 4030A protruding from side surface 21G of case 21 includes base portion 4130A and end portion 4230A. Base portion 4130A extends from side surface 21G by predetermined distance D1 in direction 1001F perpendicular to operation direction 1001B. End portion 4230A extends from base portion 4130A in direction 1001B, and has a width identical to that of base portion 4130A. Ascent portion 4037A is provided at end 4330A of front terminal 4030A, i.e., at end 4330A of end portion 4230A. Ascent portion 4037A protrudes in direction 1001L perpendicular to and away from bottom surface 4030P, and is formed by bending the end portion. Ascent portion 4037A has surface 4137A perpendicular to bottom surface 4030P. Surface 4137A faces towards direction 1001B and is perpendicular to direction 1001B. Surface 4137A is connected with end portion 4230A at straight line 4237A.

Back terminal 4030B protruding from side surface 21G of case 21 includes base portion 4130B and end portion 4230B. Base portion 4130B extends from side surface 21G by predetermined distance D2 in direction 1001F perpendicular to operation direction 1001B. End portion 4230B extends from base portion 4130B in direction 1001B, and has a width identical to that of base portion 4130B. Ascent portion 4037B is provided at end 4330B of back terminal 4130B, i.e., at end 4330B of end portion 4230B. Ascent portion 4037B protrudes in direction 1001L perpendicular to and away from bottom surface 4030P, and is formed by bending the end portion. Ascent portion 4037B has surface 4137B perpendicular to bottom surface 4030P. Surface 4137B faces towards direction 1001B and is perpendicular to direction 1001B. Surface 4137B is connected with end portion 4230B at straight line 4237B.

Front terminal 4030A protruding from side surface 21F of case 21 includes base portion 4130A and end portion 4230A. Base portion 4130A extends from side surface 21F by predetermined distance D1 in direction 1001E perpendicular to operation direction 1001B. End portion 4230A extends from base portion 4130A in direction 1001B, and has a width identical to that of base portion 4130A. Ascent portion 4037A is provided at end 4330A of front terminal 4030A, i.e., at end 4330A of end portion 4230A. Ascent portion 4037A protrudes in direction 1001L perpendicular to and away from bottom surface 4030P, and is formed by bending the end portion. Ascent portion 4037A has surface 4137A perpendicular to bottom surface 4030P. Surface 4137A faces towards direction 1001B and is perpendicular to direction 1001B. Surface 4137A is connected with end portion 4230A at straight line 4237A.

Back terminal 4030B protruding from side surface 21F of case 21 includes base portion 4130B and end portion 4230B. Base portion 4130B extends from side surface 21F by predetermined distance D2 in direction 1001E perpendicular to operation direction 1001B. End portion 4230B extends from base portion 4130B in direction 1001B, and has a width identical to that of base portion 4130B. Ascent portion 4037B is provided at end 4330B of back terminal 4030B, i.e., at end 4330B of end portion 4230B. Ascent portion 4037B protrudes in direction 1001L perpendicular to and away from bottom surface 4030P, and is formed by bending the end portion. Ascent portion 4037B has surface 4137B perpendicular to bottom surface 4030P. Surface 4137B faces towards direction 1001B and is perpendicular to direction 1001B. Surface 4137B is connected with end portion 4230B at straight line 4237B.

Two front terminals 4030A extending from side surfaces 21F and 21G, respectively, are arranged symmetrically to each other about moving axis 40J, and have shapes symmetrical to each other about moving axis 40J. Two back terminals 4030B extending from side surfaces 21F and 21G, respectively, are arranged symmetrically to each other about moving axis 40J, and have shapes symmetrical to each other about moving axis 40J.

Push switch 1005 shown in FIGS. 7A and 7B can be mounted on board 60 as securely as push switch 1001 shown in FIG. 3B, thus providing the same effects. The angle between the directions in which the end portion and the base portion extend may be an angle other than 90°.

The terminals having the above arrangements may be used in a single push switch. The terminals may protrude from side surfaces 21F and 21G of case 21 in directions 1001G, 1001H, 1001K or 1001J, respectively, but not in directions 1001E and 1001F.

The front terminals are affected by the moment produced by the operating force applied to operation portion 40A more strongly than the back terminals are. A push switch may include back terminals having shapes identical to those of terminals 5 of conventional push switch 501 shown in FIG. 9, while the push switch further includes front terminals each having one of the shapes shown in FIGS. 3B and 4A to 7A.

Figure 9:
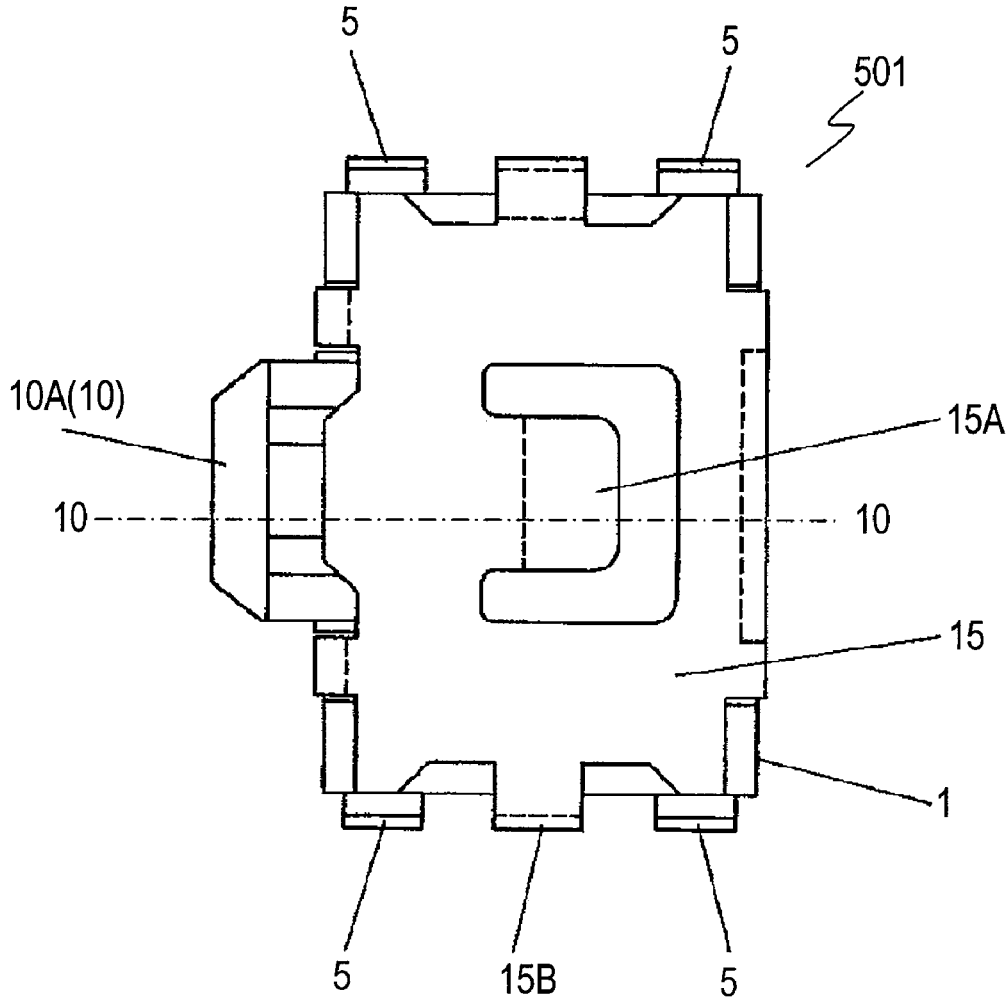
Fig. 9 PRIOR ART
FIG. 9 is a plan view of a conventional push switch.
Figure 10:
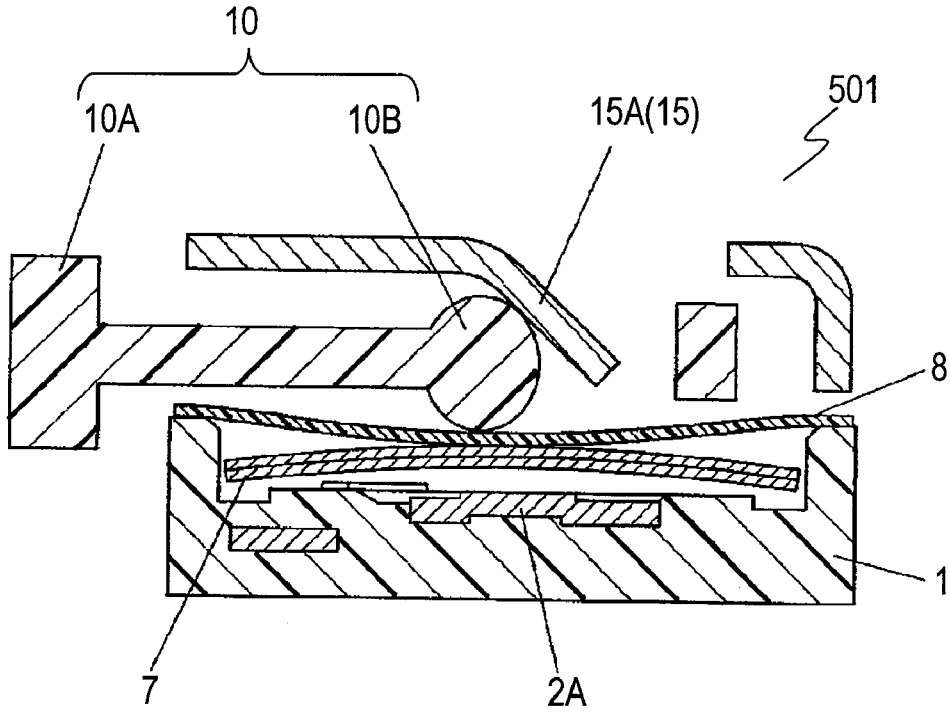
Fig. 10 PRIOR ART
FIG. 10 is a cross sectional view of the conventional push switch at line 10-10 shown in FIG. 9.
Figure 11:
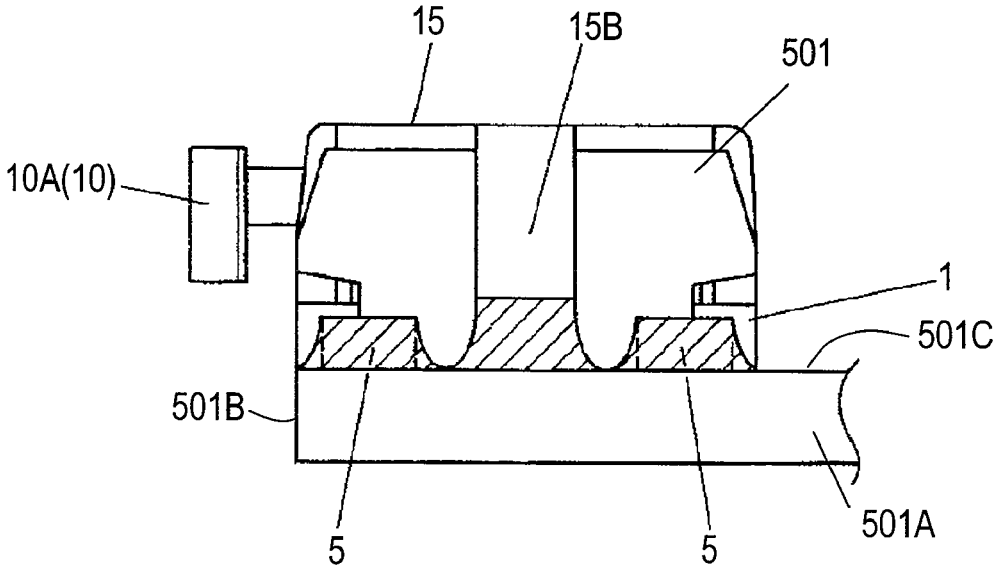
Fig. 11 PRIOR ART
FIG. 11 is a side view of the conventional push switch mounted onto a board.

Similarly to terminals 30 of push switch 1001 shown in FIG. 3B, the terminals of push switches 1002 to 1005 shown in FIGS. 4A to 7A have areas and outer side distances larger than those of terminals 5 of conventional push switch 501 shown in FIG. 9. The terminals of push switches 1001 to 1005 have greater contact areas contacting lands 61A and 61B, accordingly mounting the push switches on board 60 securely.

Similarly to terminals 30 of push switch 1001 shown in FIG. 3B, the ascent portions provided at the ends of the terminals of push switches 1002 to 1005 shown in FIGS. 4A to 7A have surfaces that are non-parallel with operation direction 1001B. This arrangement provide the surfaces with their large areas projected in direction 1001B on solder fillets 62A and 62B connecting the terminals with lands 61A and 61B. Accordingly, the terminals have large resistance against a force in direction 1001B and direction 1001A opposite to direction 1001B. Thus, push switches 1002 to 1005 are mounted on board 60 securely against the operation force applied to operation body 40.

As described above, push switches 1001 to 1005 in accordance with the embodiment can be mounted securely on board 60 without legs provided at cover 50 for soldering. The push switches are not removed easily from the board, and have a small thickness.

Lower protrusion 21A, bump 21B, and terminals 30 having various shapes may be combined for providing large effects. However, the push switch may include at least one of them. The push switch may include bump 21B according to requirement.

Figure 8:
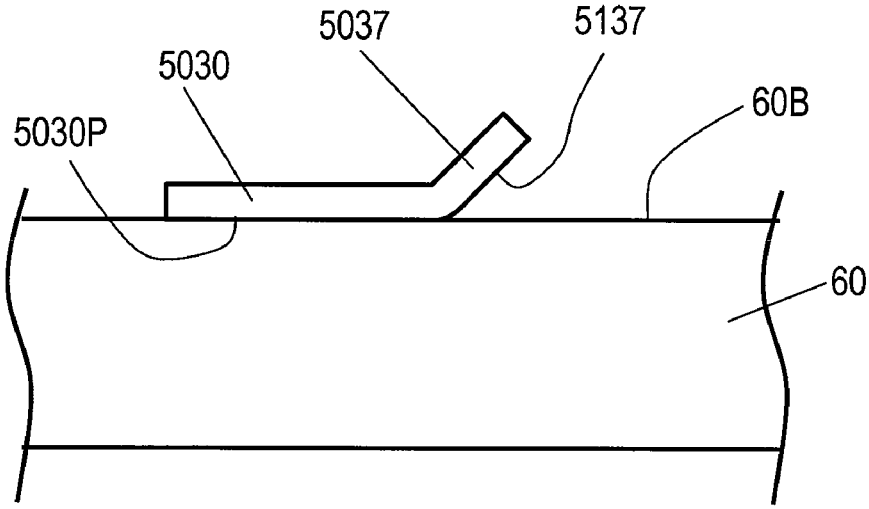
FIG. 8 is a side view of another terminal of the push switch in accordance with the embodiment.

FIG. 8 is a side view of another terminal 5030 of push switches 1001 to 1005. Terminal 5030 includes ascent portion 5037 instead of ascent portions 37A, 37B, 1037A, 1037B, 2037A, 2037B, 3037A, 3037B, 4037A, and 4037B of terminals 30A, 30B, 1030A, 1030B, 2030A, 2030B, 3030A, 3030B, 4030A, and 4030B. Terminal 5030 has bottom surface 5030P instead of bottom surfaces 30P, 1030P, 2030P, 3030P, and 4030P of terminals 30A, 30B, 1030A, 1030B, 2030A, 2030B, 3030A, 3030B, 4030A, and 4030B. Terminal 5030 has surface 5137 instead of surfaces 137A, 137B, 1137A, 1137B, 2137A, 2137B, 3137A, 3137B, 4137A, and 4137B. of terminals 30A, 30B, 1030A, 1030B, 2030A, 2030B, 3030A, 3030B, 4030A, and 4030B. Surface 5137 is not perpendicular to bottom surface 5030P, while ascent portion 5037 extends away from bottom surface 5030P. Terminal 5030 provides the same effects as terminals 30A, 30B, 1030A, 1030B, 2030A, 2030B, 3030A, 3030B, 4030A, and 4030B.

As described above, the terminal which includes the deviating end portion and the ascent portion provided at the end of the end portion is applicable to other switches and other devices including a terminal extending from a case perpendicularly to an operation direction, and provides the same effects.

What is claimed is:

1. A push switch arranged to be mounted on a surface of a board, said push switch comprising:

a case having a bottom surface, a first side surface, and a second side surface opposite to the first side surface, the bottom surface of the case being arranged to face the surface of the board while said push switch is mounted on the board;

a plurality of contacts provided in the case;

an operation body for activating the plurality of contacts upon being pushed in an operation direction parallel to the surface of the board;

a first terminal protruding from the first side surface of the case and being arranged to extend in parallel to the surface of the board, the first terminal being connected with one of the plurality of contacts; and a second terminal protruding from the second side surface of the case and being arranged to extend in parallel to the surface of the board, the second terminal being connected with one of the plurality of contacts, wherein the first terminal includes a first base portion protruding from the first side surface of the case, the first base portion having a bottom surface being arranged to be placed on the surface of the board, and a first end portion extending from the first base portion in a direction non-parallel to perpendicular to the operation direction, the first end portion having a bottom surface being arranged to be placed on the surface of the board, and the second terminal includes a second base portion protruding from the second side surface of the case, the second base portion having a bottom surface being arranged to be placed on the surface of the board, and a second end portion extending from the second base portion in a direction non-parallel to perpendicular to the operation direction, the second end portion having a bottom surface being arranged to be placed on the surface of the board.

2. The push switch of claim 1, wherein the case includes a lower protrusion protruding from the bottom surface of the case.

3. The push switch of claim 2, wherein the board has an edge having a cutout provided therein, and the lower protrusion of the case is placed in the cutout of the board while said push switch is mounted on the surface of the board.

4. The push switch of claim 3, wherein the case further includes a bump protruding from the lower protrusion in the operation direction, the cutout of the board has an edge surface facing the lower protrusion of the case, and the bump of the case contacts the edge surface of the board while said push switch is mounted on the surface of the board.

5. The push switch of claim 2, wherein the case further includes a bump protruding from the lower protrusion in the operation direction, and the bump contacts an edge of the board while said push switch is mounted on the surface of the board.

6. The push switch of claim 1, wherein the operation body includes an operation end arranged to be pushed by a user, the operation end extending in a direction towards a plane flush with the bottom surface of the case.

7. The push switch of claim 6, wherein the operation end of the operation body extends beyond the bottom surface of the case.

8. The push switch of claim 1, wherein the first terminal further includes a first ascent portion extending from an end of the first end portion away from the bottom surface of the first end portion, the first ascent portion has a surface connected in a straight line perpendicular to a direction in which the first end portion extends, the second terminal further includes a second ascent portion extending from an end of the second end portion away from the bottom surface of the second end portion, and the second ascent portion has a surface connected in a straight line perpendicular to a direction in which the second end portion extends.

9. The push switch of claim 8, wherein the surface of the first ascent portion faces towards the direction in which the first end portion extends.

10. The push switch of claim 8, wherein the surface of the second ascent portion faces towards the direction in which the second end portion extends.

11. The push switch of claim 1, wherein the operation body is movable along a moving axis in the operation direction, and the first terminal and the second terminal are arranged symmetrically to each other about the moving axis and have shapes symmetrical to each other about the moving axis.

* * * * *